US007988074B2

(12) United States Patent
Mirko

(10) Patent No.: US 7,988,074 B2
(45) Date of Patent: Aug. 2, 2011

(54) NOZZLE APPARATUS FOR MATERIAL DISPERSION IN A DRYER AND METHODS FOR DRYING MATERIALS

(75) Inventor: David A. Mirko, Payson, AZ (US)

(73) Assignee: J. Jireh Holdings LLC, Payson, AZ (US)

( * ) Notice: Subject to any disclaimer, the term of this patent is extended or adjusted under 35 U.S.C. 154(b) by 102 days.

(21) Appl. No.: 12/398,672

(22) Filed: Mar. 5, 2009

(65) Prior Publication Data

US 2009/0224065 A1 Sep. 10, 2009

Related U.S. Application Data

(60) Provisional application No. 61/068,217, filed on Mar. 5, 2008.

(51) Int. Cl.
*B05B 7/00* (2006.01)
*B05B 7/06* (2006.01)
*F26B 3/08* (2006.01)

(52) U.S. Cl. ..... 239/432; 239/132; 239/419; 239/423; 239/424.5; 34/372; 34/373; 159/4.01

(58) Field of Classification Search ..... 239/8, 101, 239/132, 132.3, 132.5, 143, 290, 398, 418, 239/419, 421, 423, 424, 424.5, 425, 427, 239/429–433; 34/359, 364, 365, 368, 369, 34/372, 373, 576, 579, 586, 588; 159/3, 159/4.01, 4.02, 4.03, 4.09, 4.1, 16.1, 48.1; 264/12

See application file for complete search history.

(56) References Cited

U.S. PATENT DOCUMENTS

| | | | | |
|---|---|---|---|---|
| 3,793,690 | A | 2/1974 | Wayne | |
| 3,994,671 | A | 11/1976 | Straitz, III | |
| 4,128,389 | A | 12/1978 | Straitz, III | |
| RE30,004 | E | 5/1979 | Reed | |
| 4,708,159 | A | 11/1987 | Lockwood, Jr. | |
| 4,819,873 | A | 4/1989 | Lockwood, Jr. | |
| 4,941,820 | A | 7/1990 | Lockwood, Jr. | |
| 5,129,583 | A * | 7/1992 | Bailey et al. | 239/427 |
| 5,152,463 | A | 10/1992 | Mao et al. | |
| 5,209,821 | A | 5/1993 | Shaw et al. | |
| 5,472,145 | A | 12/1995 | Shannon et al. | |
| 5,511,728 | A * | 4/1996 | Bailey | 239/423 |
| 5,542,609 | A * | 8/1996 | Myers et al. | 239/427 |
| 5,637,192 | A | 6/1997 | Mansour et al. | |
| 5,842,289 | A | 12/1998 | Chandran et al. | |
| 6,267,301 | B1 | 7/2001 | Haruch | |
| 6,578,777 | B2 | 6/2003 | Bui | |

(Continued)

OTHER PUBLICATIONS

Kudra, T., et al., Chapter 14—Pulse Combustion Drying, Advanced Drying Technologies, 2002, pp. 211-237, Marcel Dekker, Inc., New York, USA.

*Primary Examiner* — Darren W Gorman
(74) *Attorney, Agent, or Firm* — Clise, Billion & Cyr, P.A.; Benjamin Armitage

(57) ABSTRACT

Apparatus and methods for the dispersion of material into a drying gas stream are disclosed. The material dispersion apparatus can have a nozzle and a venturi positioned downstream of the nozzle. The drying gas stream can be generated by pulse combustion dryer or by spray dryer and pass over at least a portion of the nozzle.

1 Claim, 10 Drawing Sheets

U.S. PATENT DOCUMENTS

| | | | |
|---|---|---|---|
| 6,688,534 | B2 | 2/2004 | Bretz |
| 6,729,562 | B2 | 5/2004 | Bui |
| 6,763,607 | B2 | 7/2004 | Beyerinck et al. |
| 6,863,228 | B2 | 3/2005 | Mao et al. |
| 6,902,715 | B2 | 6/2005 | Maus et al. |
| 6,997,405 | B2 | 2/2006 | Haruch |
| 2002/0150528 | A1 | 10/2002 | Maus et al. |
| 2005/0279862 | A1 | 12/2005 | Mao et al. |
| 2006/0051288 | A1 | 3/2006 | Tsurumi et al. |
| 2007/0262173 | A1 | 11/2007 | Percival et al. |
| 2009/0004712 | A1 | 1/2009 | Rehkopf et al. |
| 2009/0019720 | A1 | 1/2009 | Grobler et al. |
| 2009/0087452 | A1 | 4/2009 | Tate et al. |

* cited by examiner 250
481

250
500
500
250
500

250
500
500
250
500

NOZZLE APPARATUS FOR MATERIAL DISPERSION IN A DRYER AND METHODS FOR DRYING MATERIALS

CROSS-REFERENCE TO RELATED APPLICATIONS

The present application claims priority from a United States Provisional Patent Application entitled Material Dispersion Apparatus and Methods and having Ser. No. 61/068,217 filed Mar. 5, 2008, the contents of which are hereby incorporated by reference in their entirety into the present disclosure.

BACKGROUND OF THE INVENTION

1. Field of the Invention

The present disclosure relates to material drying and, in particular, apparatus and methods for dispersion of material into a drying gas stream.

2. Background of the Related Art

Pulse combustion dryers and spray dryers are used to dry a variety of materials. The materials may be introduced into a drying gas stream through one or more introduction devices, which include nozzles tubes, orifices, and other such structures adapted to introduce the materials into the drying gas stream. However, the materials to be dried can be highly viscous. Frequently, the materials to be dried take the form of slurry, paste, or other non-readily flowable form that tends to clog the introduction device. The materials to be dried regularly include long molecular chains, chunks, elongated fibers, or have other such characteristics that can tend to cause clogging of the introduction device. During the drying process, these materials may form clumps, aggregations, agglomerations, and other non-uniformities in the introduction device. Current designs of introduction devices used in pulse combustion dryers may fail to adequately break up these clumps as the material is introduced into the drying gas stream. Therefore may fail to produce a generally uniform dried material in terms of moisture content and/or material size which in many applications of pulse combustion dryers is the desired result. Accordingly, a need exists for apparatus and methods for the introduction of material into a drying gas stream.

SUMMARY OF THE INVENTION

Methods and apparatus disclosed herein may resolve many of the needs and shortcomings discussed above and will provide additional improvements and advantages that may be recognized by those of ordinary skill in the art upon study of the present disclosure.

A material dispersion apparatus is provided herein. In various aspects, the material dispersion apparatus includes a nozzle. The nozzle may define a mixing chamber having a mixing chamber inlet and a mixing chamber outlet, and the mixing chamber may be adapted to receive material through the mixing chamber inlet. The nozzle defines a plenum radially disposed with respect to the mixing chamber, in various aspects, and the plenum has a plenum inlet through which the plenum receives gas. The nozzle, in various aspects, defines one or more gas ports in fluid communication with the plenum and in fluid communication with the mixing chamber to flow gas from the plenum into the mixing chamber. The nozzle defines a gap having a gap outlet, and the gap is in fluid communication with the plenum to flow gas from the plenum through the gap and out the gap outlet to cool at least a portion of the nozzle in various aspects. In various aspects, the material dispersion apparatus includes a venturi 480. The venturi 480 is disposed downstream of the nozzle such that a plume of material ejected from the mixing chamber outlet passes through a venturi throat of the venturi 480 in various aspects.

Methods of dispersing material are provided herein. In various aspects, the methods include flowing a drying gas stream past a nozzle, introducing material into a mixing chamber of the nozzle; swirling the material within the mixing chamber by injecting gas into the mixing chamber; forming a plume in the drying gas stream by ejecting the material from the mixing chamber into the drying gas stream; shaping the plume by positioning a body within the mixing chamber, and passing the plume through a venturi throat of a venturi 480.

Other features and advantages of the methods, apparatus, and compositions disclosed herein will become apparent from the following detailed description and from the claims.

Figure 1:
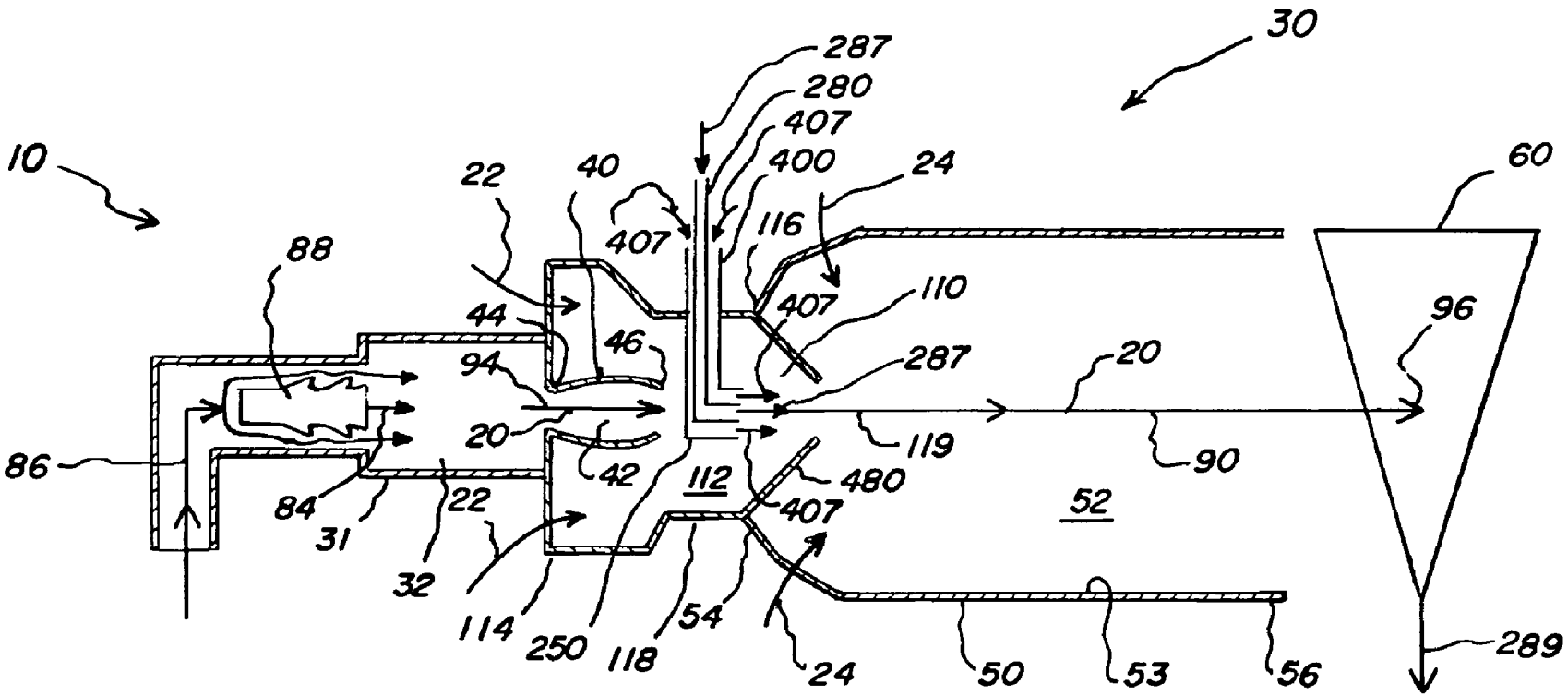
FIG. 1 illustrates by schematic an exemplary embodiment of a pulse combustion dryer in accordance with aspects of the present inventions.

All Figures are illustrated for ease of explanation of the basic teachings of the present inventions only; the extensions of the Figures with respect to number, position, order, relationship and dimensions will be explained or will be within the skill of the art after the following description has been read and understood. Further, the apparatus, materials and other operational parameters to conform to specific size, dimension, force, weight, strength, velocity, temperatures, flow and similar requirements will likewise be within the skill of the art after the following description has been read and understood.

Where used to describe the drawings, the terms "top," "bottom," "right," "left," "forward," "rear," "first," "second," "inside," "outside," and similar terms may be used, the terms should be understood to reference the structure and methods described in the specification and illustrated in the drawings as they generally correspond to their with the apparatus and methods in accordance with the present inventions as will be recognized by those skilled in the art upon study of the present disclosure.

DETAILED DESCRIPTION OF THE INVENTION

The present inventions provide material dispersion apparatus 10 and methods for the dispersion of material 287 into a drying gas stream 20. The drying gas stream 20, in various aspects, is generated within a pulse combustion dryer 30, and the material 287 is dispersed in the drying gas stream 20 to dry the material 287 into dried material. The drying gas stream 20 is typically a high velocity gas stream 20 and may have a velocity in excess often (10) meters per second. The material dispersion apparatus 10 may include a nozzle 250 and may, in various aspects, include a venturi 480 to introduce material 287 for drying into the gas steam 20. The material 287 passes into a mixing chamber defined by the nozzle 250, and gas is introduced into the mixing chamber from a plenum 452 radially disposed about at least portions of the mixing chamber to atomize the material 287 and/or eject the material 287 from the nozzle 250 in various aspects. A body 510 secured to a support 470 may be disposed axially within the mixing chamber 520 to aid in the atomization of the material 287 and dispersion of the material 287 into the drying gas stream 20. A venturi 480 may be provided downstream of the nozzle 250 so that a plume of material 287 ejected through the nozzle 250 passes through a venturi throat 489 of the venturi 480 in order to be further atomized by the drying gas stream 20 and dispersed in the drying gas stream 20 as the drying gas stream 20 is accelerated through the venturi throat 489 of the venturi 480.

Methods for dispersion of material 287 into the drying gas stream 20 may include atomizing the material 287 within the mixing chamber of the nozzle 250 by injection of gas into the mixing chamber. The methods may include propelling the material 287 forth from the mixing chamber into the drying gas stream 20 by injecting gas into the mixing chamber. In various aspects, the methods may include inducing swirl in the material 287 by injecting gas into the mixing chamber. The methods may include passing the plume of material 287 emanating from the nozzle 250 through a venturi throat 489 of the venturi 480 in order to atomize and/or disperse the material 287 into the drying gas stream 20. The methods may include positioning the nozzle 250 with respect to the venturi throat 489 to control the atomizing of material 287 and/or the dispersing of material 287 into the drying gas stream 20.

The Figures generally illustrate various exemplary embodiments of the material dispersion apparatus 10 and methods. The particular exemplary embodiments illustrated in the Figures have been chosen for ease of explanation and understanding. These illustrated embodiments are not meant to limit the scope of coverage, but, instead, to assist in understanding the context of the language used in this specification and in the claims. Accordingly, variations of the material dispersion apparatus 10 and methods that differ from the illustrated embodiments may be encompassed by the appended claims.

The material 287 typically includes water or other solvent or carrier with one or more dryable components suspended, dissolved, or otherwise entrained therein. Carrier, as used herein, includes water as well as other evaporable solvents. The dryable component(s) may be organic components, inorganic components, or combinations of organic and inorganic components. The material 287 may be readily flowable, or may be viscous, in the form of a slurry, a paste, viscous fluid or other form as would be recognized by those of ordinary skill in the art upon review of the present disclosure. The material 287 may include long molecular chains such as cellulose and/or other sizable components that may clog an orifice, gap, aperture, or other opening. The material 287 may include chunks, aggregations, agglomerations, fibrous or otherwise stringy materials, etc. that may clog or otherwise foul an orifice, gap, aperture, or other such opening. Atomization in the present context means the breakup, disaggregation or other breaking apart of the material 287 into smaller units and/or into the native size.

Dried material 289 is the material 287 with the water (including other solvent(s)) removed. In various aspects, the water may be removed from the material 287 so that the resulting dried material 289 is less than about 20% water by weight and may be less than 10% water by weight.

The material 287 may be introduced into the drying gas stream 20 by the material dispersion apparatus 10 in order to dry the material 287 into the dried material 289. In some aspects, the drying gas stream 20 may be generated within a spray dryer, and in other aspects, the drying gas stream may be generated within a pulse combustion dryer 30. The drying gas stream 20 within the spray dryer is generally continuous and of low velocity in many aspects, with velocities, for example, of about 70 mph or less. The drying gas stream 20 within the pulse combustion dryer may have velocities ranging up to about 400-500 mph and may, in some aspects, even include supersonic velocities and/or shockwaves. The drying gas stream 20 may be pulsed, and the pulses may have a frequency ranging from about 30 Hz to about 1,000 Hz with about 120 Hz being a natural frequency in various aspects. Pressures in the drying gas stream may be about $2\times10^4$ Pa (gage) or more in various aspects. Sound pressures in the drying gas stream 20 may fall in the range of about 100 dB to about 200 dB in various aspects. In various aspects, a swirl component of velocity may be induced into the drying gas stream 20.

As generally illustrated in the Figures, the material dispersion apparatus 10 may include a nozzle 250 having a nozzle first end 254 and a nozzle second end 256, and a venturi 480. The nozzle 250 is configured to define a plenum 452 and a mixing chamber 520 with the plenum 452 radially disposed about the mixing chamber 520, in various aspects. Material 287 may be conveyed from a material conduit 280 into the mixing chamber 520 generally through a mixing chamber inlet 527 proximate the nozzle first end 254 of the nozzle 250. Gas 407 may be communicated into the plenum 452 generally through a plenum inlet 451 proximate the nozzle first end 254 from a gas conduit 400, and the gas 407 may be injected into the material 287 within the mixing chamber 520 from the plenum 452 in order to atomize the material 287 and/or eject the material 287 out of the nozzle second end 256 of the nozzle 250 into the drying gas stream 20. Accordingly, the gas 407 may be communicated from the plenum 452 into the mixing chamber through one or more ports disposed about the mixing chamber 520 adapted to impart radial, axial, and/or angular (swirl) components of velocity and combinations thereof to the gas 407, and, hence to the material 287 entrained by the gas 407 within the mixing chamber in order to effectively atomize the material 287 and/or disperse the material 287 into the drying gas stream 20. Injection of gas 407 into the mixing chamber 520 may allow the material 287 to be communicated through the material conduit passage 282 into the mixing chamber 520 under low pressure, and the gas 407 may expel material 287 into the drying gas stream 20 wherein the material 287 has a viscous, non-Newtonian, slurry, paste, or similar form. Various agglomerations including non-uniformities and suchlike may exist within the material 287, and the gas 407 may atomize these agglomerations to produce a more uniform dried material 289.

The material 287 may form a plume as it is dispersed into the drying gas stream 20. In various aspects, the nozzle 250 includes a body 510 secured to a support 470 medially disposed within the mixing chamber 520 along axis 818 to aid in the atomization of the material and/or affect the shape of the plume, such as, for example, the radial spread of the plume.

The nozzle 250 can include a gap 458 which is a passage that extends generally circumferentially around the nozzle 250 from the plenum 452 to the nozzle second end 256 and exits the nozzle 250 at a gap outlet 457 generally proximate the nozzle second end 256. Gas 407 may be communicated from the plenum 452 through the gap 458 and out of the gap exit 457 in order to cool at least portions of the nozzle 250. The gas 407, in some aspects, may be air. In other aspects, the gas 407 could be, for example, nitrogen or carbon dioxide, and in still other aspects, the gas 407 could be an inert gas such as helium.

An embodiment of the pulse combustion dryer 30 illustrated in FIG. 1, which includes the combustor 31, the tailpipe 40, the atomizer 110 and the drying chamber 50, as well as the material dispersion apparatus 10. With continuing reference to FIG. 1 in the following, the combustor 31 defines a combustion chamber 32, the tailpipe 40 defines a tailpipe passage 42 having a tailpipe passage first end 44 and a tailpipe passage second end 46, the atomizer 110 defines an atomizer chamber 112 having an atomizer chamber first end 114 and an atomizer chamber second end 116, and the drying chamber 50 defines by the drying chamber passage inner wall 53 a drying chamber passage 52 having a drying chamber passage first end 54 and a drying chamber passage second end 56. The combustion chamber 32 fluidly communicates with the tailpipe passage 42 through the tailpipe passage first end 44. The tailpipe 40 is disposed with respect to the atomizer 110 such that the tailpipe passage 42 fluidly communicates through the tailpipe passage second end 46 into the atomizer chamber 112 generally proximate the atomizer chamber first end 114. The atomizer chamber 112, in turn, fluidly communicates through the atomizer chamber second end 116 into the drying chamber passage 52 generally proximate the drying chamber passage first end 54. The collector 60 is disposed about the drying chamber passage second end 56 of the drying chamber 50 in fluid communication with the drying chamber passage 52 to collect dried material 289 from the drying gas stream 20. In other embodiments, the collector 60 could be otherwise disposed with respect to the drying chamber 50.

Fuel 84 and combustion air 86 are admitted into the combustion chamber 32 to be ignited periodically in order to produce the drying gas stream 20, as illustrated in FIG. 1. An air valve 88 is disposed in the path of the combustion air 88 in this embodiment to admit combustion air 86 into the combustion chamber 32 while generally preventing backflows of the drying gas stream 20. As illustrated in FIG. 1, the flow of the drying gas stream 20 from the combustion chamber 32, through the tailpipe passage 42, through the atomizer chamber 112, through the drying chamber passage 52, and into the collector 69 defines the flow path 90. The first end 94 of the flow path 90 is generally within the combustion chamber 32, and the second end 96 of the flow path 90 is generally proximate the collector 60, which is disposed about the drying chamber passage second end 56 of the drying chamber 50, in this embodiment.

With continuing reference to the embodiment illustrated in FIG. 1 in the following, the drying gas stream 20 may be generated within the pulse combustion dryer 30, and material 287 may be dispersed into the drying gas stream 20 to be dried into dried material 289. Material 287 may be dispersed into the drying gas stream 20 at the introduction location 118 through nozzle 250. In this embodiment, the introduction location 118 is within the atomizer chamber 112, and the material 287 is generally dispersed into the drying gas stream 20 by the nozzle 250 within the atomizer chamber 112. The nozzle 250, as illustrated, is downstream of the tailpipe passage second end 46 of the tailpipe 40 so that material 287 is dispersed from the nozzle 250 into the drying gas stream 20 as the drying gas stream 20 emerges from the tailpipe passage 42. The material 287 is carried by the drying gas stream 20 through the atomizer chamber 112. The drying gas stream 20 with material 287 entrained therein exits the atomizer chamber 112 at the atomizer chamber second end 116 through the venturi 480, passes into the drying chamber passage 52, and, thence, through the drying chamber passage 52 into collector 60. The collector 60 captures the dried material 289 from the drying gas stream 20.

In other embodiments, the introduction location 118 could be within the tailpipe passage 42 or within the drying chamber passage 52, and the atomizer chamber 112 may be omitted. In various embodiments, a plurality of nozzles 250 may be provided and these may define a plurality of introduction locations 118. One or more nozzles 250 may be disposed at an off-set from the atomizer chamber centerline 119 or other centerline to introduce the material 287 into the drying gas stream 20. For example, a plurality of nozzles 250 may be disposed circumferentially at a constant radial location with respect to the atomizer chamber centerline 119.

As illustrated in FIG. 1, the material 287 may be introduced into the drying gas stream 20 through the nozzle 250 to be entrained into the drying gas stream 20 and dried into dried material 289. The collector 60 is positioned proximate the drying chamber passage second end 56 and generally defines the second end 96 of the flow path 90, in this illustrated embodiment. The dried material 289 may then be recovered from the drying gas stream 20 by the collector 60. The collector 60 may be a baghouse, filter(s), screen(s), or similar or combinations thereof configured to capture the dried material 289 from the drying gas stream 20, as would be recognized by those of ordinary skill in the art upon study of this disclosure.

In various embodiments of the pulse combustion dryer 30, one or more additional airflows may be admitted into the atomizer chamber 112 and/or the drying chamber passage 52. For example, as illustrated in FIG. 1, quench air 22 may be admitted into the atomizer 110 generally proximate the atomizer chamber first end 114 to control the temperature of the drying gas stream 20 within the atomizer chamber 112 and the drying chamber passage 52. The quantity of quench air 22 admitted into the atomizer chamber 112 may be regulated in order to control the temperature of the drying gas stream 20 including the temperature proximate the introduction location 118. In the embodiment of FIG. 1, dilution air 24 may also introduced into the drying chamber passage 52 generally proximate the first drying chamber passage end 54 to provide thermodynamic space for the uptake of water evaporated from the material 287 in order to prevent water condensation and/or saturation conditions in the drying chamber passage 52 and/or in the collector 60. The dilution air 24 may regulate the temperature of the drying gas stream 20. The quantity of dilution air 24 admitted into the drying chamber passage 52 may be regulated in various embodiments.

Figure 2A:
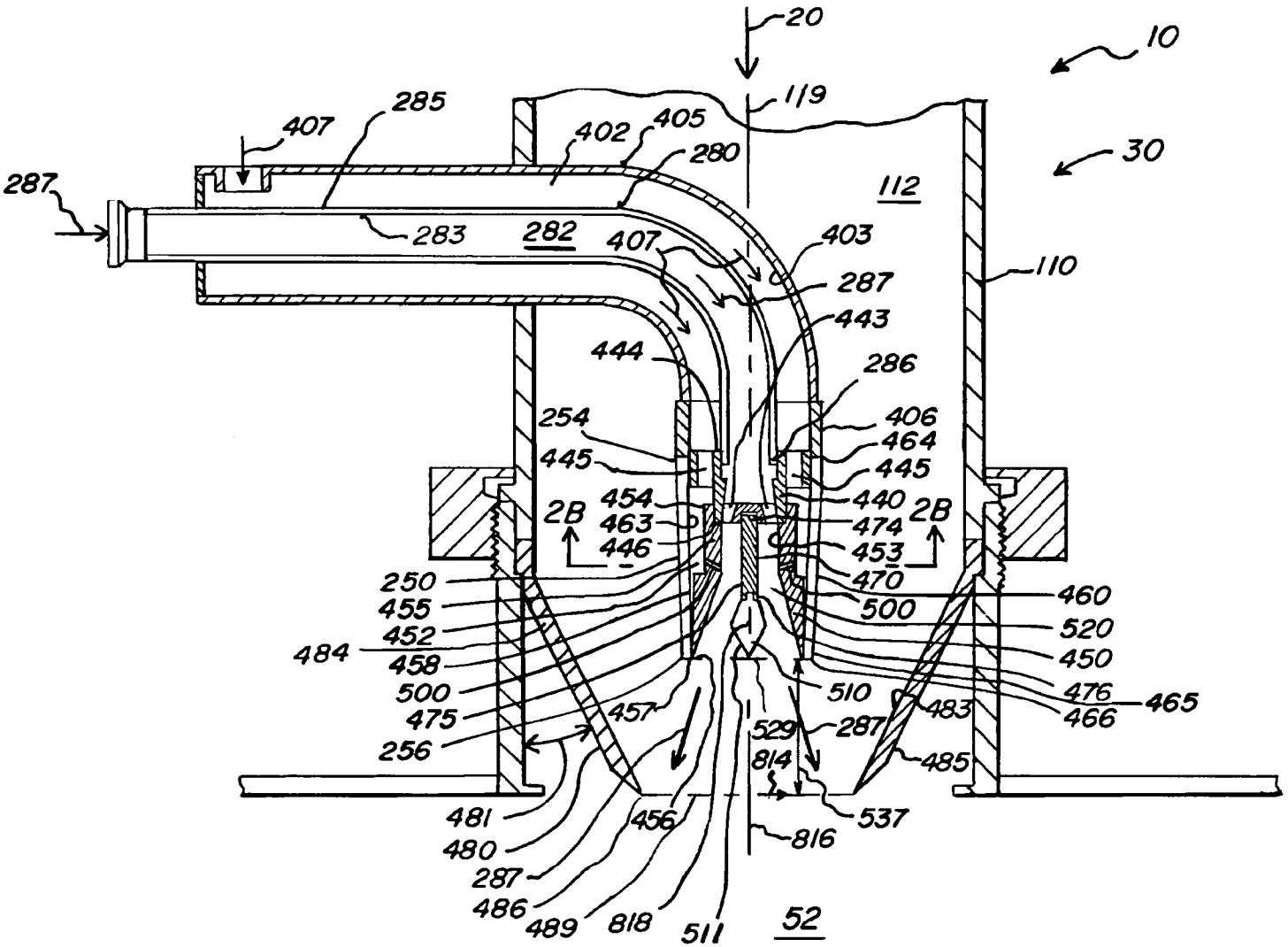
FIG. 2A illustrates by side cross-sectional view portions of an exemplary embodiment of the material dispersion apparatus in accordance with aspects of the present inventions.

FIG. 2A illustrates an embodiment of the material dispersion apparatus 10. The gas conduit 400 and the material conduit 280 are also included in this Figure. The gas conduit 400 is disposed about the material conduit 280 such that a gas conduit inner wall 403 and a material conduit outer wall 285 define a gas conduit passage 402 to convey gas 407, as illustrated, and a material conduit inner wall 283 defines a material conduit passage 282 to convey material 287. The nozzle 250, as illustrated, is secured to gas conduit second end 406 of the gas conduit 400 and to material conduit second end 286 of the material conduit 280 such that gas 407 may be communicated through the gas conduit passage 402 into the plenum 452 and gap 458 and material 287 may be communicated into the mixing chamber 520 through the material conduit passage 282.

With continuing reference to FIG. 2A in the following, the material dispersion apparatus 10 includes the nozzle 250 with nozzle first end 254 and nozzle second end 256, and venturi 480. The nozzle 250 includes base 440, inner shell 450, outer shell 460, support 470, and body 510.

The base 440 has a base first surface 444 and a base second surface 446, and defines one or more base inner passages 443 and base outer passages 445 to communicate fluid between the base first surface 444 and the base second surface 446. The base 440 is configured to secure the nozzle 250 to the material conduit 280 and to the gas conduit 400 with the base first surface 444 generally oriented toward the gas conduit passage 402 and the material conduit passage 282.

The inner shell 450 has an inner shell first end 454, an inner shell second end 456, an inner shell inner wall 453, and an inner shell outer wall 455. The outer shell 460 has an outer shell first end 464, an outer shell second end 466, an outer shell inner wall 463 and an outer shell outer wall 465. The support 470 has a support first end 474 and a support second end 476. The inner shell first end 454, the outer shell first end 464 and the support first end 474 engage base second surface 446 of the base 440.

The inner shell inner surface 453 of the inner shell 450 is generally circular about nozzle axis 818 as the inner shell 450 extends distally from the base second surface 446. The outer shell 460 extends distally from the base second surface 446 and is generally circular about nozzle axis 818. In various embodiments, the radii of the inner shell 450 and/or the outer shell 460 may be constant or may vary along the nozzle axis 818. The second end 456 of the inner shell 450 is substantially coextensive with the second end 466 of the outer shell 460 to form the nozzle second end 256 of the nozzle 250.

Support first end 474 of support 470 is secured to the base 440, and the support 470 extends along axis 818 distally from the base second surface 446. The body 510 is secured to the support second end 476 in this embodiment. The support 470 is generally cylindrical in this embodiment, but, in other embodiments, the support 470 could assume other shapes such as, for example, a polygonal shape.

The inner shell inner surface 453, the base second surface 446, support outer surface 475, and at least portions of the body surface 511 define mixing chamber 520. One or more base inner passages 443 defined by the base 440 form the mixing chamber inlet 527, and material 287 may flow into the mixing chamber 520 from the material conduit passage 282 through the one or more base inner passages 443. Inner shell second end 456 and portions of the body surface 511 define the mixing chamber outlet 529 proximate the nozzle second end 256 through which material 287 may be expelled into the drying gas stream 20. The nozzle axis 818 may be generally aligned in axial direction 816 to be parallel with the flow path 90 of the drying gas stream 20 so that the material 287 is expelled through the mixing chamber outlet 529 of the mixing chamber 520 in the axial direction 816 to be dispersed into the drying gas stream 20. The body 510 is configured to spread the plume of material 287 in the radial direction 814 as the material 287 is expelled out of the mixing chamber 520 into the drying gas stream 20.

Portions of the outer shell inner surface 463 generally proximate the outer shell first end 464, portions of the inner shell outer surface 455 generally proximate the inner shell first end 454, and portions of the base second surface 446 define the plenum 452. Portions of the outer shell inner surface 463 generally proximate the outer shell second end 466 and portions of the inner shell outer surface 455 generally proximate in inner shell second end 456 define gap 458. The gap 458 terminates with gap outlet 457 at the nozzle second end 256, as shown. The plenum 452 is in fluid communication with the gas conduit passage 402 through the plenum inlet 452, which is formed by one or more base outer passages 445, as shown, and the plenum 452 is in fluid communication with the gap 458. Accordingly, gas 407 may flow into the plenum 452 from the gas conduit passage 402 through one or more base outer passages 455 that make up the plenum inlet 451. A portion of the gas 407 may flow from the plenum 452 through the gap 458 and exit the nozzle second end 256 at the gap outlet 457, as illustrated. The flow of gas 407 through the plenum 450 and through gap 458 may dissipate heat communicated into the outer shell 460 from the drying gas stream 20 as the drying gas stream 20 contacts the outer shell outer wall 465 in order to prevent thermal degradation of the material within the mixing chamber 520. The gas in the gas conduit passage 402 may insulate the material conduit 280 and/or flow of gas through the gas conduit passage 402 may dissipate heat from the drying gas stream 20 in order to protect material 287 in the material conduit passage 282.

As illustrated in FIG. 2A, gas 407 may be injected through one or more gas ports 500 from the plenum 452 into the mixing chamber 520 to atomize the material and/or expel the material 287 out of the mixing chamber 520 through the mixing chamber outlet 529 into the drying gas stream 20. The injection of gas 407 into material 287 occurs in the mixing chamber 520 downstream of the base second surface 446 of the base 440. This allows liquid material 287 to flow through base inner passage(s) 443, which represent constriction(s) in the flow, without clogging the base inner passage(s) 443. Only after the liquid material 287 has passed through the base inner passage(s) 443 is air injected into the material 287. It has been found that material 287 containing long molecular chains such as cellulose as well as other lumps, aggregates, agglomerations, non-homogeneities, stringy materials, and suchlike generally flows through the base inner passage(s) 443 or similar constrictions without clogging. By contrast, injection of gas 407 into such materials upstream of the base inner passage(s) 443 including orifice(s), and similar constrictions tends to result in clogging of the base inner passage (s) 443.

At least portions of the inner shell inner surface 453 may be flared, as illustrated, and the flared portions of the inner shell inner surface 453 may be generally parallel to portions of the body surface 511 of the body 510 to spread the plume of material 287 in the drying gas stream 20 in the radial direction 814 outward from the mixing chamber 520 as the material 287 is expelled in the axial direction 816 out of the mixing chamber 520. Accordingly, the material 287 may have velocity components in both the radial direction 814 and in the axial direction 816 as the material 287 is expelled from the mixing chamber 520 into the drying gas stream 20. Radial spreading of the plume may enhance dispersion of the material 287 into the drying gas stream 20. The radial velocity component may spread the material 287 into the drying gas stream 20 outside of a wake region in the drying gas stream 20 created by portions of the nozzle 250, which may enhance dispersion of the material 287 into the drying gas stream 20 and may enhance the atomization of the material 287 by the drying gas stream 20.

The support 470 with body 510 secured thereto is provided to enhance atomization of the material 287 and to spread the material 287 in the radial direction 814 as the material 287 is dispersed into the drying gas stream 20. The material 287 may be atomized by impact upon the body surface 511 of the body 510 and/or upon the support outer surface 475 of the support 470. Injection of gas 407 into the mixing chamber 520 may accelerate the material 287 to cause the material 287 to impact the body surface 511 and/or support outer surface 475 and, thereby, enhance the atomization of the material 287. Forces and turbulence created in the mixing chamber 520 by the injection of gas 407 into the material 287 within the mixing chamber 520 may also atomize the material 287.

The body surface 511 and/or the support outer surface 475 may also spread the material 287 radially into the drying gas stream 20. The body 510, as illustrated, is substantially symmetrical about axis 818 and has an angular tear-drop shape, but in other embodiments could have other shapes such as, for example, a spherical shape. Various shapes of the body 510 may vary the shape of the plume of material 287 in the radial direction 814. Similarly, variations in the shape of the support outer surface 475 may vary the shape of the plume of material 287 in the radial direction 814.

The embodiment illustrated in FIG. 2A includes venturi 480 interposed between the atomizer chamber 112 of the atomizer 110 and the drying chamber passage 52. In various embodiments, the venturi 480 may be configured as an orifice plate, a nozzle, venturi 480, or similar as would be recognized by those of ordinary skill in the art upon study of this disclosure. The venturi 480, as illustrated, includes a venturi 480 first surface 483, which is oriented upstream, a venturi 480 second surface 485, which is oriented downstream, a venturi 480 outer periphery 484, and a venturi 480 inner periphery 486. The inner periphery 486 defines the venturi throat 489. The venturi 480 outer periphery 484 is mounted to the atomizer 110 such that the venturi throat 489 is downstream of the nozzle 250 and the drying gas stream 20 along with the plume of material 287 ejected from the nozzle 250 into the drying gas stream 20 is directed through the venturi throat 489. The venturi 480 may accelerate the drying gas stream 20 including the plume of material 287 proximate the venturi throat 489 while creating vortices and turbulence that may enhance dispersal of material 287 into the drying gas stream 20 and/or atomization of the material 287. The venturi 480 is formed as a flat plat with a bevel about inner periphery 486, and the venturi 480 defines a venturi 480 angle 481 with the drying gas stream, which is parallel to the wall as indicated in the Figure. The venturi 480 angle 481 could vary from about 30° to about 90° (an orifice) in various embodiments. In various embodiments, the venturi 480 could be formed to include various curved surfaces as would be recognized by those of ordinary skill in the art upon study of this disclosure.

The nozzle second end 256 is oriented toward the venturi throat 489 such that the nozzle axis 818 is generally aligned with the center of the venturi throat 489 in order to introduce material 287 uniformly into the drying gas stream 20 with respect to the venturi throat 489. The nozzle second end 256 is set at distance 537 from the venturi throat 489. The material dispersion apparatus 10 may be adapted to allow the distance 537 to be altered in various embodiments in order to optimize the atomization of the material 287 and the dispersion of the material 287 into the drying gas stream 20. The distance 537 may depend upon the nature of the material 287 including the water content and the characteristics of the drying gas stream 20.

As illustrated in FIG. 2A, the nozzle 250 is threadedly engaged with the gas conduit second end 406 and the material conduit second end 286, and the components of the nozzle 250 including the base 440, inner shell 450, outer shell 460, support 470, and body 510 are threadedly connected to one another, as illustrated, to allow for the disassembly, substitution of components, and/or removal of components. For example, the support 470 and the body 510 may be machined out of a unitary piece of stock to be of unitary construction. As an additional example, the inner shell 450 and the outer shell 460 could be formed as a unitary piece and the base 440 configured to receive threadedly this unitary piece. In other embodiments, the components could be welded to one another, cast as a unitary piece, machined out of a unitary piece of stock, combinations thereof, or otherwise connected, and, accordingly, various collars, nipples, as well as gaskets, o-rings, and other such parts and fittings may be included, as would be recognized by those of ordinary skill in the art upon study of this disclosure. The venturi 480, as illustrated, is threadedly engaged with the atomizer 110, which allows for removal and substitution. In various other embodiments, the venturi 480 could be affixed by welding or in other ways and various auxiliary fittings could be provided, as would be recognized by those of ordinary skill in the art upon study of this disclosure.

Figure 2B:
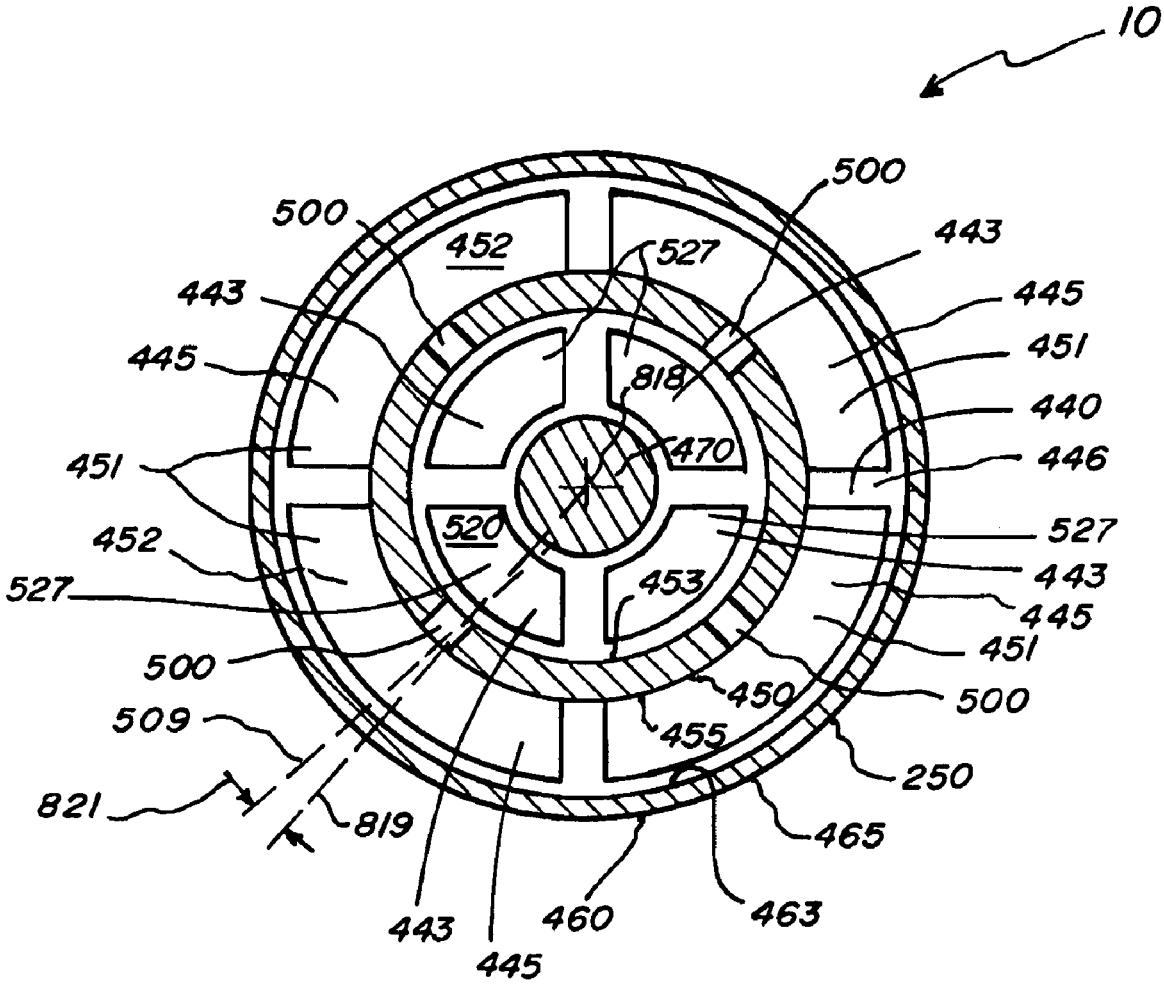
FIG. 2B illustrates by frontal cross-sectional view portions of an exemplary embodiment of a nozzle generally corresponding to FIG. 2A in accordance with aspects of the present inventions.

A cross-section of the nozzle illustrated in FIG. 2A is generally illustrated in FIG. 2B. With continuing reference to FIG. 2B in the following, a plurality of gas ports 500 are disposed at regular positions circumferentially about the inner shell 450 to communicate gas 407 from the plenum 451 into the mixing chamber 520. The gas port 500 defines a gas port centerline 509. The gas port 500 is oriented such that the gas port centerline 509 defines a gas port radial angle 821 with respect to a radial line 819 emanating radially from the nozzle axis 818. The gas port radial angle 821 may range from about 10° to about 30° in various embodiments. Accordingly, the gas 407 imparts a swirling motion (angular velocity) to the material 287 in the mixing chamber 520, which may enhance the atomization of the material 287 and/or dispersion of the material 287 into the drying gas stream 20. Because the gas port centerline 509 is offset at gas port radial angle 821, gas 407 communicated through the gas port 500 as well as material 287 entrained by the gas 407 tends to strike the body 510 and/or support 470 tangentially, which may reduce abrasion of the body 510 and/or support 470.

Figure 2C:
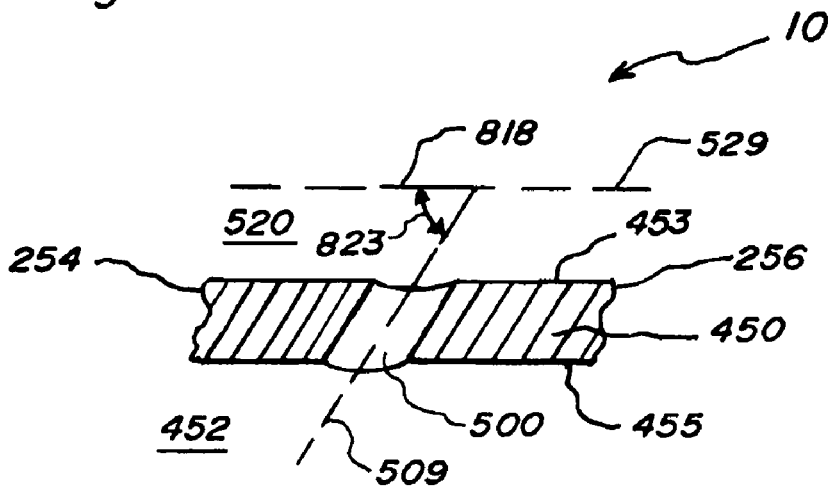
FIG. 2C illustrates by cross-sectional view a detail of an exemplary embodiment of a nozzle generally corresponding to FIG. 2A in accordance with aspects of the present inventions.

A detailed cross-section through the gas port 500 is illustrated in FIG. 2C, which is oriented with the nozzle first end 254 and the nozzle second end 256 generally as indicated. The gas port centerline 509 defines gas port axial angle 823 with respect to the nozzle axis 818, as illustrated. The gas port axial angle 823 may be about 90° in some embodiments (substantially perpendicular to the nozzle axis 818) to swirl the material 287 in the mixing chamber 520. In other embodiments, the gas port angle 823 may be canted at less than 90° to propel the material 287 toward the mixing chamber outlet 529. By canting the gas port axial angle 823 away from the perpendicular, the gas 407 imparts an axial velocity in the direction of the mixing chamber outlet 529 to the material 287 within the mixing chamber 520 to eject the material 287 from the mixing chamber 520 into the drying gas stream 20.

Figure 3:
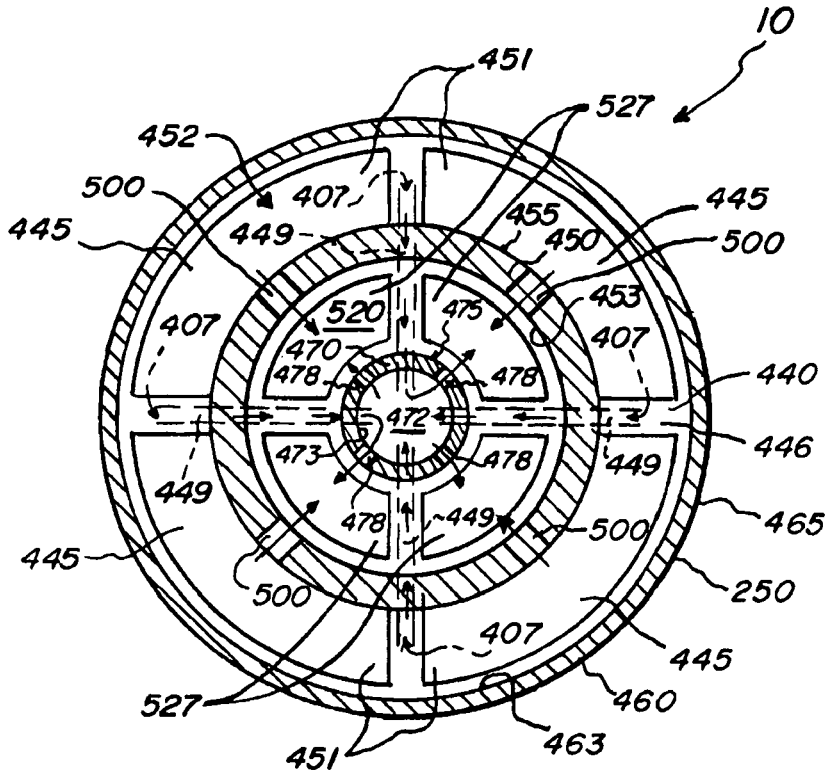
FIG. 3 illustrates by frontal cross-sectional view portions of another exemplary embodiment of a nozzle in accordance with aspects of the present inventions.

FIG. 3 illustrates another embodiment of the nozzle 250 by a cross-sectional view in the axial direction 816. In this embodiment, the support 470 includes a support inner surface 473 that defines a support plenum 472. Gas 407 may be communicated from the plenum 452 to the support plenum 472 via base lumen 449 configured within the base 440. The gas 407 may then be injected into the mixing chamber 520 from the support plenum 452 through one or more support gas ports 478 disposed about the support 470. The support gas port(s) 478 may be adapted to induce swirl into the material 287 within the mixing chamber 520 and/or to impart an axial velocity in the direction of the mixing chamber outlet 529 to the material 287 within the mixing chamber 520 to eject the material 287 from the mixing chamber 520 into the drying gas stream 20. Some embodiments may include both gas port(s) 500 and support gas port(s) 478 and the gas port(s) 500 may be adapted to cooperate with the support gas port(s) 478 to impart various motions to the material 287 within the mixing chamber 520. Other embodiments may include only gas port (s) 500, and still other embodiments may include only support gas port(s) 478.

Figure 4:
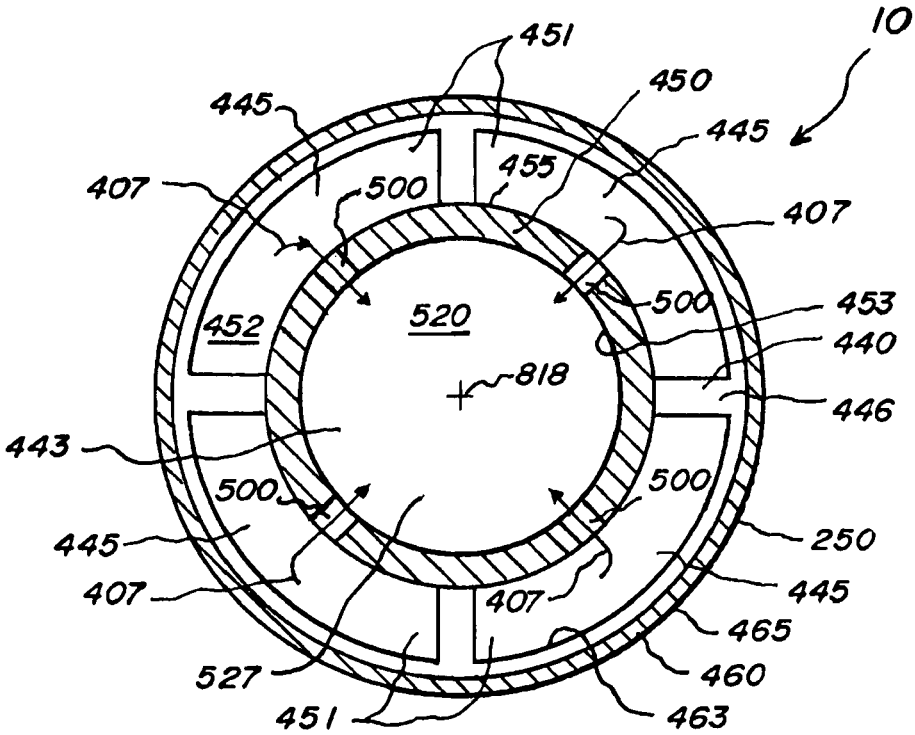
FIG. 4 illustrates by frontal cross-sectional view portions of still another exemplary embodiment of a nozzle in accordance with aspects of the present inventions.

FIG. 4 illustrates another embodiment of the nozzle 250 by a cross-sectional view in the axial direction 816. In this embodiment, the nozzle 250 includes base 440, outer shell 460 and inner shell 450. The inner shell 450 and the outer shell 460 are secured to the base 440 to define the plenum 452 and the mixing chamber 520. As illustrated in FIG. 4, the support 470 and body 510 have been eliminated as well as portions of the base 440 to which the support first end 474 of the support 470 may be secured. The mixing chamber 520, in this embodiment, may have generally the same diameter as the material conduit passage 282 with the point of engagement between the inner shell 450 and the base 440 generally defining the proximal end of the mixing chamber 520 and the base inner passage 443. Accordingly, material 287 may be communicated from the material conduit passage 282 into the mixing chamber 520 without passing through constrictions that could become clogged by the material 287. Gas 407 is injected into the material 287 within the mixing chamber 520 through gas ports 500 to atomize the material 287 and/or eject the material from the mixing chamber 520, as illustrated.

Figure 5A:
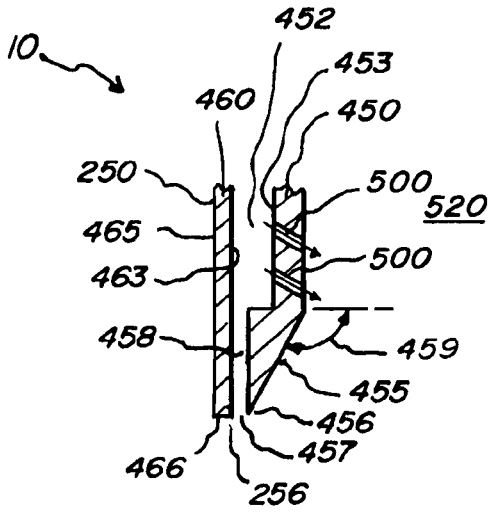
FIG. 5A illustrates by side cross-sectional view portions of an exemplary embodiment of a nozzle in accordance with aspects of the present inventions.
Figure 5B:
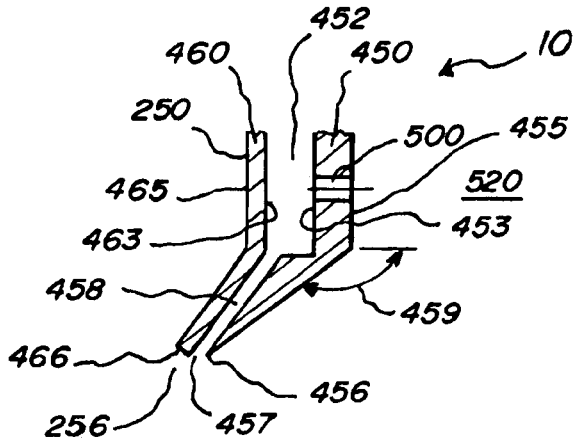
FIG. 5B illustrates by side cross-sectional view portions of another exemplary embodiment of a nozzle in accordance with aspects of the present inventions.

FIGS. 5A and 5B illustrate portions of the nozzle generally proximate the gap outlet 457. As illustrated in FIG. 5A, the outer shell inner surface 463 of the outer shell 460 and the inner shell outer surface 455 of the inner shell 450 define the plenum 452 and the gap 458. Gas ports 500 are disposed axially along the inner shell 450 to inject gas 407 from the plenum 452 into the mixing chamber 520 in this embodiment. In some embodiments, one or more gas ports 500 may be disposed to inject gas 407 from the gap 458 into the mixing chamber 520. In various embodiments, the gas ports 500 may be disposed axially, circumferentially, or combinations thereof, and the gas port radial angles 821 and the gas port axial angles 823 defined by the gas ports 500 may be essentially the same for each gas port 500 or may vary among the gas ports 500.

The outer shell 460 is generally straight in the axial direction 816, as illustrated in FIG. 5A, while the inner shell 450 is adapted to flare radially outward at wall angle 459 to spread the plume of material 287 in the drying gas stream 20. In FIG. 5B, portions of the outer shell 460 are flared radially outward and the inner shell 450 flares radially outward at an obtuse wall angle 459. In FIG. 5B the gap outlet 457 is angled to impart a radial velocity component to the gas 407 as well as an axial velocity component as the gas 407 exits the gap outlet 457 in order to affect the shape of the plume of material 287 in the drying gas stream 20. One of ordinary skill in the art will recognize other configurations of the inner shell 450, outer shell 460, and gap outlet 457 upon study of the present disclosure that may adjust the shape of the plume.

Figure 6:
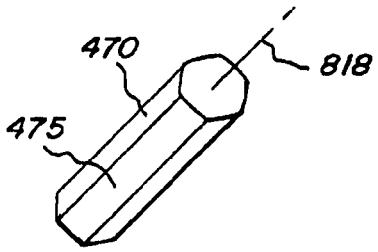
FIG. 6 illustrates by perspective view an exemplary embodiment of a support in accordance with aspects of the present inventions.

FIG. 6 illustrates an embodiment of the support 470 wherein the support surface 475 defines a regular polygon about nozzle axis 818. The angled support outer surface 475 of the support 470 may increase atomization of the material 287. One of ordinary skill in the art will recognize other configurations of the support 470 including the support outer surface 475 that may effect atomization and/or the shape of the plume upon study of the present disclosure.

Figure 7A:
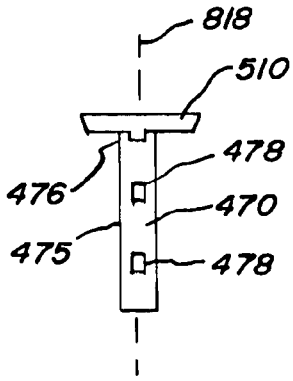
FIG. 7A illustrates by side view an exemplary embodiment of a body secured to a support in accordance with aspects of the present inventions.
Figure 7B:
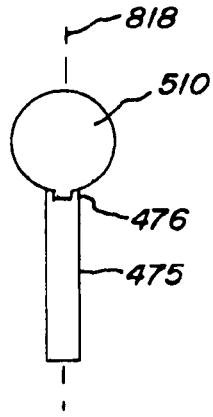
FIG. 7B illustrates by side view another exemplary embodiment of a body secured to a support in accordance with aspects of the present inventions.
Figure 8:
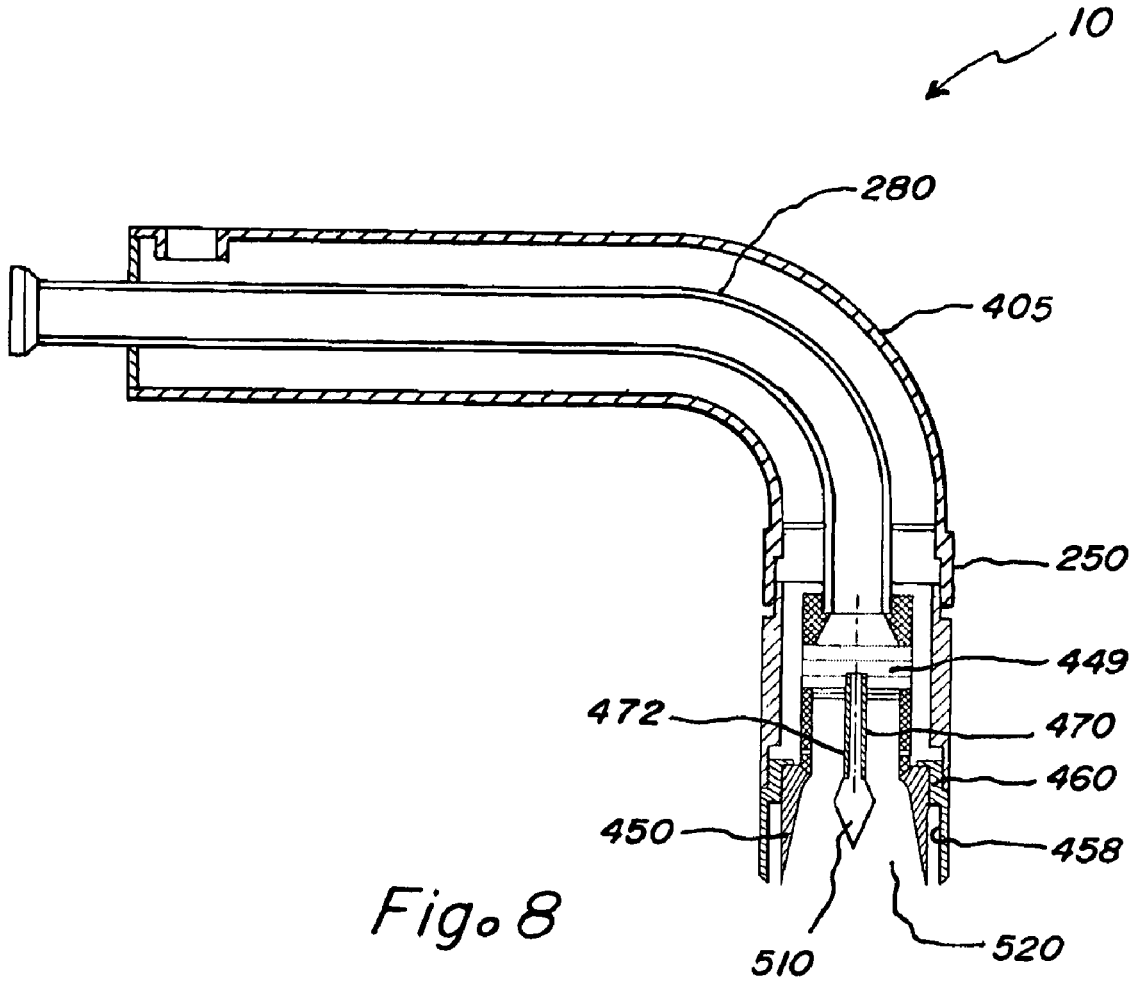
FIG. 8 illustrates by cross-sectional view portions of an exemplary embodiment of the material dispersion apparatus in accordance with aspects of the present inventions.
Figure 9:
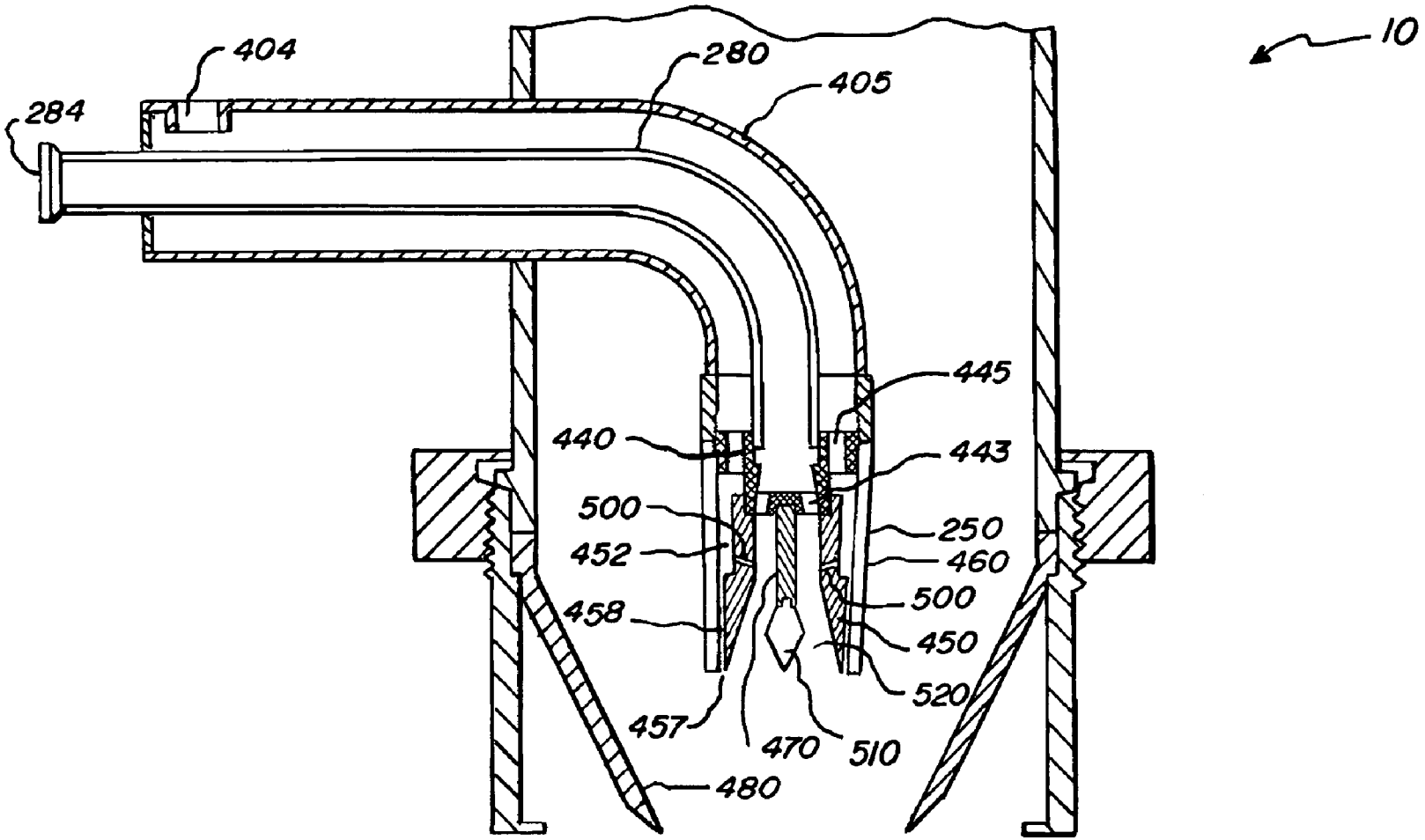
FIG. 9 illustrates by cross-sectional view portions of an exemplary embodiment of the material dispersion apparatus in accordance with aspects of the present inventions.
Figure 10:
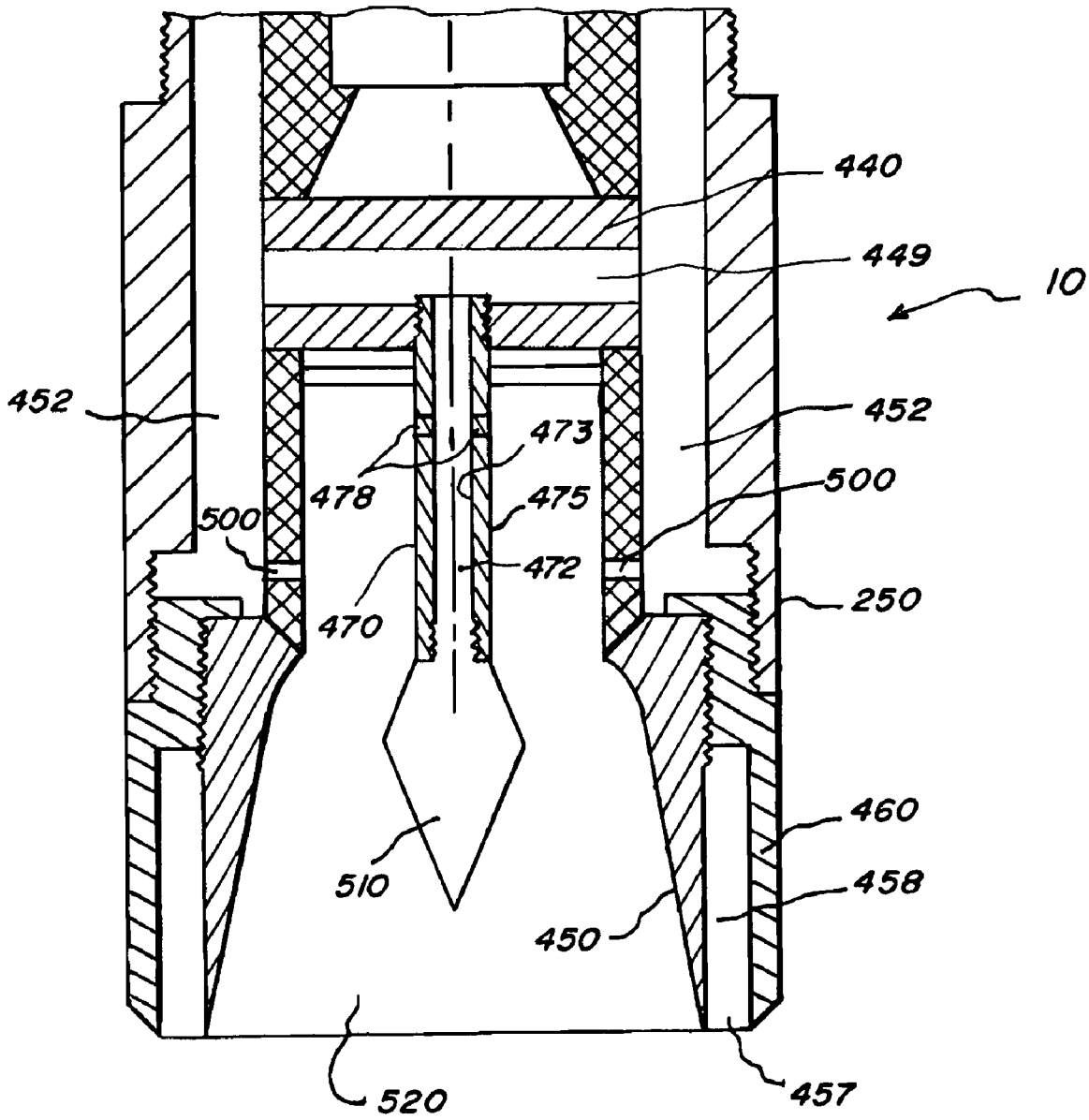
FIG. 10 illustrates by cross-sectional view portions of an exemplary embodiment of the material dispersion apparatus in accordance with aspects of the present inventions.
Figure 11A:
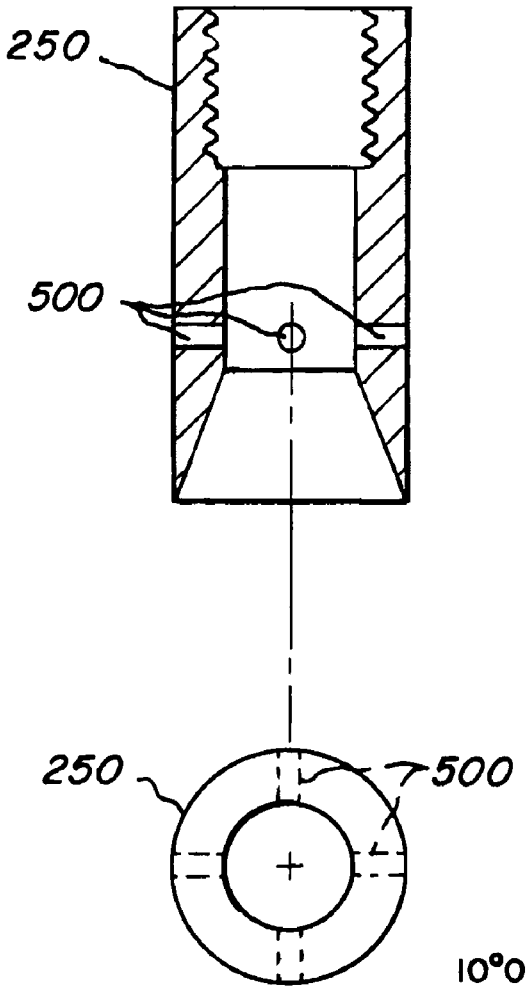
FIG. 11A illustrates by cross-sectional view portions of an exemplary embodiment of the material dispersion apparatus in accordance with aspects of the present inventions.
Figure 11B:
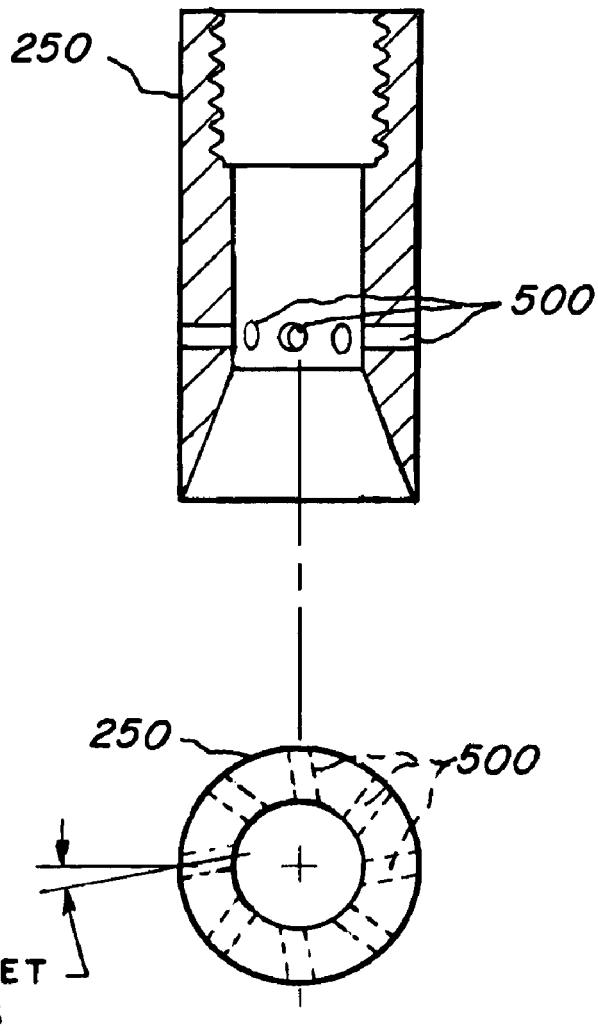
FIG. 11B illustrates by cross-sectional view portions of an exemplary embodiment of the material dispersion apparatus in accordance with aspects of the present inventions.
Figures 11C, 11D, 11E:
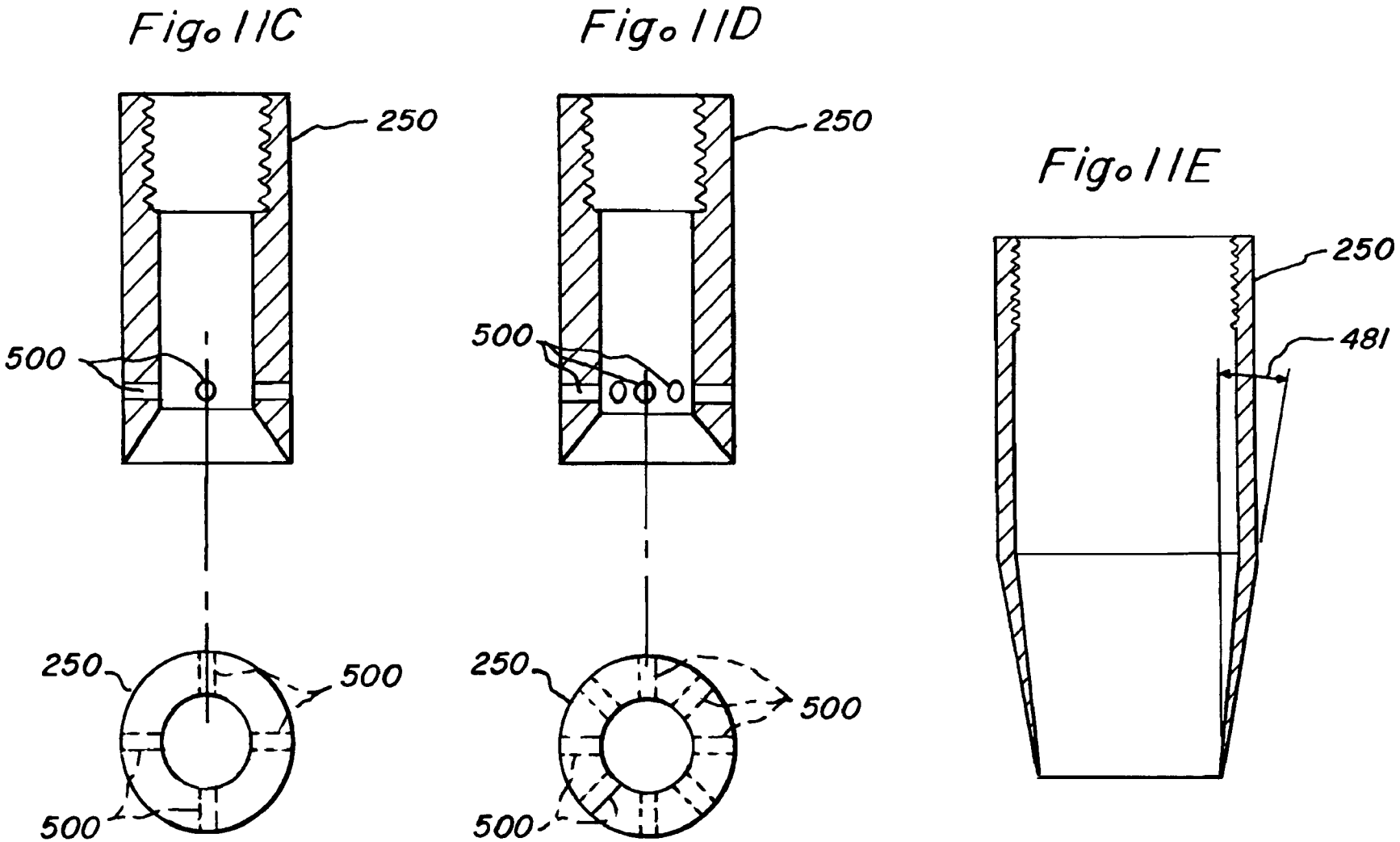
FIG. 11C illustrates by cross-sectional view portions of an exemplary embodiment of the material dispersion apparatus in accordance with aspects of the present inventions.
FIG. 11D illustrates by cross-sectional view portions of an exemplary embodiment of the material dispersion apparatus in accordance with aspects of the present inventions.
FIG. 11E illustrates by cross-sectional view portions of an exemplary embodiment of the material dispersion apparatus in accordance with aspects of the present inventions.

FIGS. 7A and 7B illustrate various embodiments of the support 470 and body 510. As illustrated in FIG. 7A, a plurality of support gas ports 478 may be disposed axially along the support 470. In various embodiments, the gas ports 478 may be disposed circumferentially and/or axially about the support 470 in ways readily recognizable by one of ordinary skill in the art upon study of this disclosure. The body 510 is configured as a circular disc in FIG. 7A, and as a sphere in FIG. 7B, and may have other shapes in various other embodiments as would be recognized by those of ordinary skill in the art upon study of this disclosure.

In operation, material 287 is introduced into the mixing chamber 520 from the material conduit passage 282 at the mixing chamber inlet 527 through the base inner passage(s) 443. Gas 407 is introduced into the plenum 452 from the gas conduit passage 402 through one or more base outer passages 445. The gas 407 is injected into the mixing chamber 520 from the plenum 452 through one or more gas port(s) 500 and/or through one or more support gas port(s) 478 to atomize the material 287 and/or eject the material 287 out of the mixing chamber 520 into the drying gas stream 20. The nozzle 250 may be disposed with respect to the venturi 480 such that the resulting plume of material 287 emanating from the nozzle 250 passes through the venturi throat 489 of the venturi 480 to be further atomized and/or dispersed into the drying gas stream 20. Depending upon the nature of the material 287, the position of the nozzle 250 with respect to the venturi 480 may be adjusted in order to control the dispersion of the material 287 into the drying gas stream 20 including the shape of the plume, the atomization of the material 287, and/or drying of the material 287.

The body 510 secured to support 470 is disposed within the mixing chamber 520, in some aspects, in order to enhance the atomization of the material 287 and/or control the shape of the plume of material 287 in the drying gas stream 20. In particular, the body 510 may be adapted to enhance the radial spread of the plume in various aspects.

Methods for dispersion of material 287 into the drying gas stream 20 are provided herein. In various aspects, the methods may include flowing the drying gas stream 20 past the nozzle 250 and may include flowing the drying gas stream 20 through a venturi throat 489 of a venturi 480. The methods may include introducing the material 287 into the mixing chamber 520 of the nozzle 250 wherein the mixing chamber 520 is downstream of the base inner passage 443 of the base 440 including various orifices, apertures, and other constrictions, and introducing gas 407 into the mixing chamber 520. Producing swirl in the mixing chamber 452 by introducing gas 407 into the mixing chamber 452 may be included in the methods. Various aspects may include ejecting the material 287 from the mixing chamber outlet 529 of the mixing chamber 520 using the gas 407 and may include atomizing the material 287 in the mixing chamber 520 using the gas 407. Various aspects may include inducing a swirling motion to the material 287 within the mixing chamber 520 using the gas 407.

The methods, in various aspects, include cooling at least portions of the nozzle 250 by flowing the gas 407 through one or more gaps 458 and thence out of one or more gap outlets 457 adapted about the nozzle second end 256 of the nozzle 250. The methods in various aspects include controlling the shape of the plume of material 287 by providing a body 510 secured to a support 470 within the mixing chamber 520. The methods may also include controlling the shape of the plume by the configuring of the ports into the mixing chamber 520 through which the gas 407 is introduced.

In various aspects, the methods include flowing the drying gas stream 20 with the material 287 entrained therein through the venturi throat 489 of the venturi 480. The methods, in various aspects, include controlling the atomizing of the material 287 and/or the dispersing of the material 287 into the drying gas stream 20 by positioning the nozzle second end 256 of the nozzle 250 with respect to the venturi throat 489.

The foregoing discussion discloses and describes merely exemplary embodiments. Upon study of the specification, one of ordinary skill in the art will readily recognize from such discussion, and from the accompanying figures and claims, that various changes, modifications and variations can be made therein without departing from the spirit and scope of the invention as defined in the following claims.

What is claimed is:

1. A material dispersion apparatus, comprising:

a nozzle, the nozzle defines a mixing chamber having a mixing chamber inlet and a mixing chamber outlet, the mixing chamber adapted to receive material through the mixing chamber inlet, the nozzle defines a plenum radially disposed with respect to the mixing chamber, the plenum has a plenum inlet through which the plenum receives gas, the nozzle defines one or more gas ports in fluid communication with the plenum and in fluid communication with the mixing chamber to flow gas from the plenum into the mixing chamber, the nozzle defines a gap having a gap outlet, the gap is in fluid communication with the plenum to flow gas from the plenum through the gap and out the gap outlet to cool at least a portion of the nozzle; and a venturi, the venturi disposed downstream of the nozzle such that a plume of material ejected from the mixing chamber outlet passes through a venturi throat of the venturi;

wherein the nozzle includes a body secured to a support medially disposed within the mixing chamber along an axis to aid in the atomization of the material, affect a shape of a plume or both.

* * * * *